United States Patent [19]

Johnson et al.

[11] Patent Number: 4,967,323

[45] Date of Patent: Oct. 30, 1990

[54] ADJUSTABLE APPAREL-HELD FLASHLIGHT

[75] Inventors: Melissa C. Johnson, 758 Main St., Leominster, Mass. 01453; Robert Howitt, Leominster, Mass.

[73] Assignee: Melissa C. Johnson, Leominster, Mass.

[21] Appl. No.: 430,144

[22] Filed: Nov. 1, 1989

[51] Int. Cl.[5] ..... F21L 15/14

[52] U.S. Cl. ..... 362/103; 362/105; 362/190; 362/197

[58] Field of Search ..... 362/190, 191, 197, 199, 362/103, 105, 106

[56] References Cited

U.S. PATENT DOCUMENTS

| | | | |
|---|---|---|---|
| 1,741,264 | 12/1929 | Wappler | 362/105 |
| 1,752,343 | 4/1930 | Kann | 362/199 |
| 2,117,967 | 5/1938 | Leipold et al. | 362/105 |
| 3,008,040 | 11/1961 | Moore | 362/105 |
| 3,830,230 | 8/1974 | Chester | 362/105 |
| 4,406,040 | 9/1983 | Cannone | 362/106 |
| 4,533,982 | 8/1985 | Kozar | 362/191 |

*Primary Examiner*—Ira S. Lazarus
*Assistant Examiner*—Sue Hagarman
*Attorney, Agent, or Firm*—Charles R. Fay

[57] ABSTRACT

A flashlight having a flat base for application to a user's clothing where desired or convenient, the flashlight being somewhat elongated with a lamp bulb at one end and a supporting ball and socket at the other end, on the base, the ball and socket being such as to allow manual swiveling of the beam of light while still maintaining the position of the beam of light in the desired direction, as by friction between ball and socket.

14 Claims, 2 Drawing Sheets

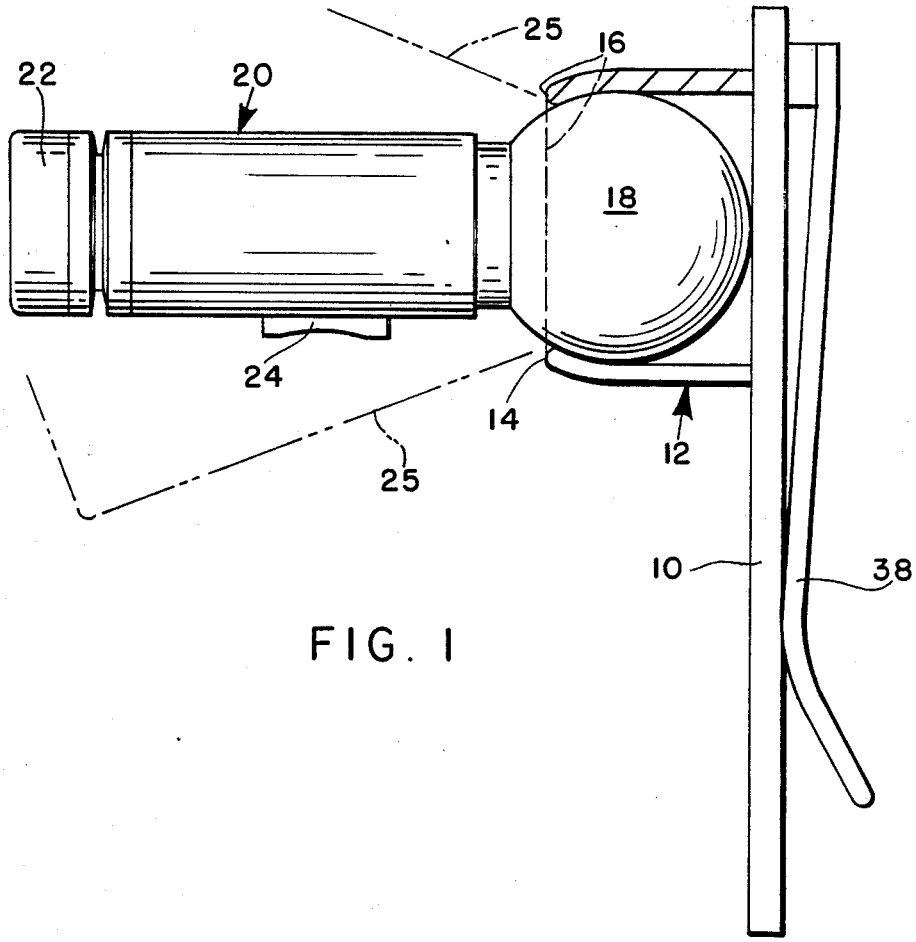
FIG. 1
FIG. 2
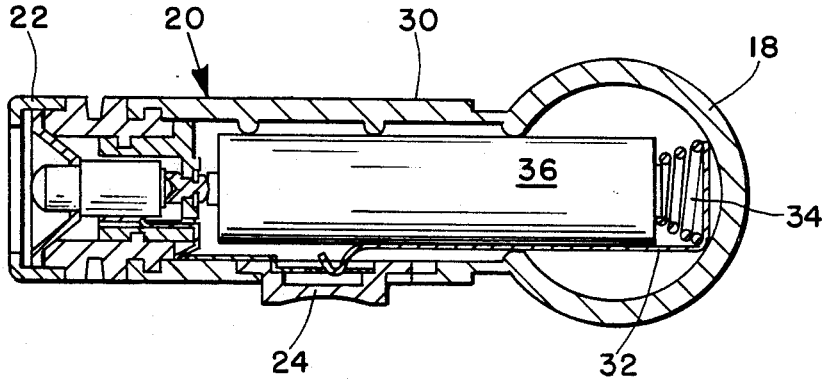

ADJUSTABLE APPAREL-HELD FLASHLIGHT

BACKGROUND OF THE INVENTION

There have been many flashlights proposed with body and apparel mounts for many purposes, e.g., fishing, repair work, nursing. etc., at night and especially where it is desired not to bother another person, as in nursing and child care. Most of the examples found are cumbersome, heavy, or expensive and it is the object of this invention to provide an inexpensive, light weight, and quick and easy attachment to apparel. The present device is quickly attached to apparel and quickly and easily adjusted to light relatively small area, leaving both hands free to attend the patient or any other business at hand.

SUMMARY OF THE INVENTION

A small, flat, lightweight plate has a pin at one side for quick attachment to the apparel, but not to the body, of the user. At its opposite side the plate has fixed and possibly integral thereto a socket opening away from the plate, which becomes a base for the flashlight An elongated cylindrical casing holds a battery, switch, and a lamp bulb, the bulb having a removable mount at one end of the casing and a ball to fit the base socket at the other end in extension thereof. The ball fits the socket in frictional relation thereto, so that the base mounts and carries the flashlight with no other means than the socket. The flashlight is easily and quickly swiveled about the center of the ball in any direction not intersected by the base plate, and stays where it is so manually positioned. When not in use, the flashlight is swiveled down onto the base plate. The base plate and the flashlight may be made of commercial plastic material.

BRIEF DESCRIPTION OF THE DRAWING

FIG. 1 is a view in side elevation of the flashlight, part in section;

FIG. 2 is a sectional view through the flashlight but omitting its base.,

PREFERRED EMBODIMENT OF THE INVENTION

Figure 3:
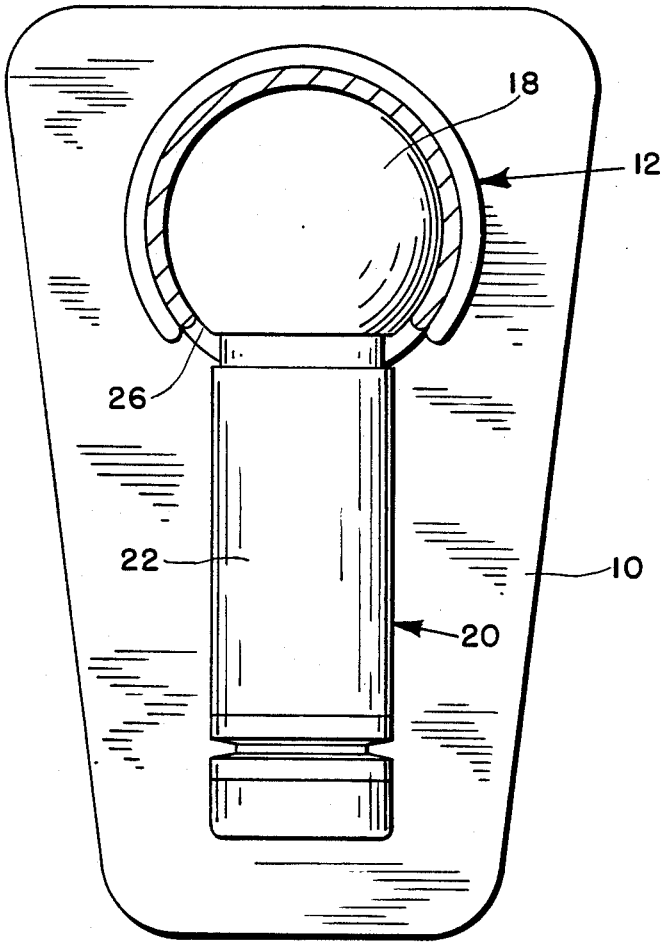
FIG. 3 is a section of the socket showing the opening therein to allow the flashlight to be placed generally parallel to the base.

The entire flashlight of the present invention is lightweight and relatively small having an overall length of three inches more or less. It comprises a base 10 with a socket on one side and an apparel securement means of desired or convenient kind at the opposite side. The socket is either integral or secured to the base by adhesives or mechanical means. This socket is generally indicated at 12 and is a hollow, circular shell having an axis at a right angle to the base being closed thereby at one side and open as at 14 at the other side. The opening 14 has an inturned lip 16 to provide a snap-in receptacle for a hollow ball 18 that has a diameter just a little greater than the diameter of the opening in the socket provided by the inturned lip 16. The ball 18 is a swivel support for a flashlight apparatus generally indicated at 20 having as usual a light or lamp bulb housing 22 and a switch actuator 24.

FIG. 1 shows that the flashlight including its ball 18 can swivel relative to base 10 in a circle having a center at the center of the ball, see broken lines 26, and preferably the socket 12 has a lower slot at 26 so that when not in use, the flashlight and ball may be turned down and out of the way, on base 10. This is not shown in FIG. 1 because it is desired to illustrate the hold of the socket on the ball, and it is emphasized that once snapped into the socket, the ball is not wanted to be removed at any time from the socket.

FIG. 2 shows the details of the flashlight including the housing 30 and attached ball 18.

The ball holds electrode 32 and spring 34 for battery 36; the conventional on and off switch 24 is mounted in housing 30, and a lamp bulb assembly of the usual type is screw-threaded onto the end of housing 30 opposite the ball. It is believed that the details of the lamp bulb assembly need not be further described as it, as well as the battery, switch, etc., are well-known and commercially available.

Figure 4:
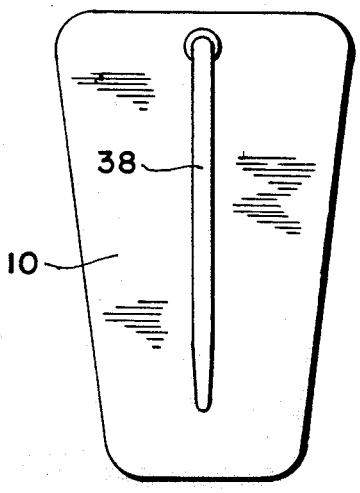
FIGS. 4 and 5 are details showing preferred ways of securing the flashlight to the apparel.
Figure 5:
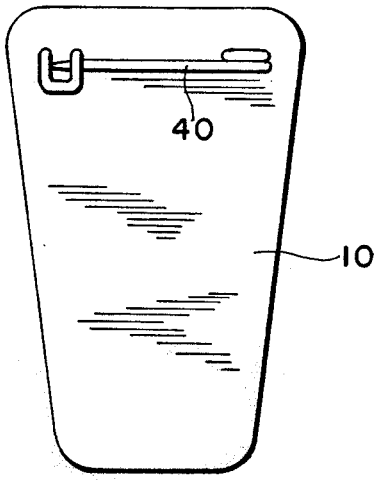

FIGS. 4 and 5 show the side of the base opposite the socket with a spring clip 38 in FIG. 4 and a pin 40 in FIG. 5 with which to connect the base 10 to a shirt or blouse pocket or to pin it to apparel where convenient.

Thus it is seen that this small, light, flashlight can be used at night. Persons working at night, and especially nurses, can benefit because the light is set where the light is needed and it then frees both hands for work with the patient. Currently, nurses must hold the flashlight with one hand, or place it on a table or bed and move it around so they can see what they are doing. Once correctly positioned, the present flashlight remains so adjusted until readjusted by the operator.

We claim:

1. An apparel mounted flashlight comprising a mounting base having a pair of opposite sides, securement means on one side of the base for temporarily securing the base to the apparel of the user in any convenient or desired location.

a socket on the other side of the base extending outwardly from the base at a right angle thereto, a hollow ball mounted in the socket with a friction fit between the ball and socket, the ball and socket being of a material and cooperating size such that the ball may be swiveled in the socket and will remain in the position to which it is swiveled until moved once more in the socket by the direct action of hand manipulation, a cylindrical casing on the ball, said casing having a hollow interior forming an outward extension of the interior of said hollow ball, a flashlight lamp bulb, a battery, and a switch therefor mounted in the casing, the battery being located in the casing co-axially with the casing and adjacent to the ball, the lamp bulb being located at the end of the casing opposite the ball, said casing being angularly adjustable relative to said base by manually swivelling said ball within said socket for up, down and sidewise motions of said casing, and means within said casing connecting said battery, said lamp and said switch in electrical circuit for energizing said lamp when said switch is closed and for deenergizing said lamp when said switch is opened.

2. The flashlight of claim 1 wherein the casing and the lamp bulb extends outboard from the apparel-mounted base, the lamp bulb being farthest from the base, and a replaceable mount for the lamp bulb on the casing at its outermost end.

3. The flashlight of claim 3 wherein the switch is located on the casing between the ends thereof.

4. The flashlight of claim 4 wherein the ball and casing form an open ended single integral member, the outboard lamp bulb mount closing the casing.

5. The flashlight of claim 1 wherein the casing is swivelable to a flat-down position on the base when not in use.

6. The flashlight of claim 1 wherein said securement means comprises a spring clip for connecting the base to a shirt or blouse pocket.

7. The flashlight of claim 1 wherein said securement means comprises a pin for pinning said base to the apparel of the user.

8. The flashlight of claim 1 wherein said base is a flat plate and said socket comprises a hollow circular shell having an axis which is at a right angle to said base, said shell having one end closed by said base and an open end opposite to said base, said open end of said socket having an inturned lip, said hollow shell providing a snap-in receptacle for said hollow ball, said hollow ball having a diameter which is greater than the diameter of the opening in the socket provided by the inturned lip.

9. The flashlight of claim 8 wherein said socket is integral with said base.

10. The flashlight of claim 1 wherein said battery extends a substantial distance into said hollow ball.

11. The flashlight of claim 1 wherein said means within said casing connecting said battery, said lamp and said switch in electrical circuit includes an electrically conductive spring and an electrically conductive strip within said ball and casing, said spring being interposed between one end of said battery and one end of said conductive spring, said spring and said conductive spring being positioned within said ball so that the spring biases said battery toward said lamp bulb, said conductive spring extending from said spring along side of said battery to said switch.

12. A flashlight comprising an elongated cylindrical casing, an opening at one end of the casing, the other end being closed, a lamp bulb mount closing the opening and a lamp bulb positioned in the mount to project light out of the mount and casing generally co-axial with the casing, the closed end of the casing terminating in a hollow ball having a diameter greater than the diameter of the casing, a battery in the casing and having an end portion thereof extending a significant distance into the ball, a switch on a side of the casing between the lamp bulb mount and the ball, a base plate, a socket on the base plate, said socket receiving the ball and holding and supporting the ball so that the casing extends outwardly from the base plate, and can be swiveled manually by means of the ball and socket in arcs having the center of the ball as a center, the ball and socket being adapted to cooperate for the swivel action while engaging each other with a friction grip strong enough to maintain the casing where placed by hand.

13. The flashlight of claim 12 wherein the battery extends into the ball a distance greater than the diameter of the ball, and a battery-engaging spring in the ball between the battery and an area of the ball co-axial with the battery.

14. The flashlight of claim 12 wherein the casing swivel action includes an inactive position wherein the casing is substantially parallel to the base and generally flat thereon.

* * * * *